US008593047B2

(12) United States Patent
Wei et al.

(10) Patent No.: US 8,593,047 B2
(45) Date of Patent: Nov. 26, 2013

(54) FIELD EMISSION UNIT AND PIXEL TUBE FOR FIELD EMISSION DISPLAY

(75) Inventors: Yang Wei, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/981,577

(22) Filed: Dec. 30, 2010

(65) Prior Publication Data

US 2012/0133270 A1 May 31, 2012

(30) Foreign Application Priority Data

Nov. 29, 2010 (CN) ..... 2010 1 0564731

(51) Int. Cl.
*H01J 1/304* (2006.01)

(52) U.S. Cl.
USPC ..... 313/309; 313/351; 313/495; 313/310; 313/346 R

(58) Field of Classification Search
USPC ..... 313/495–497, 306, 308–310, 351, 355, 313/293–304; 445/49–51; 427/77; 257/167, 257/10–11; 438/20; 315/169.1, 169.3
See application file for complete search history.

(56) References Cited

U.S. PATENT DOCUMENTS

| | | | | |
|---|---|---|---|---|
| 7,550,907 | B2 | 6/2009 | Jiang et al. | |
| 7,741,765 | B2 | 6/2010 | Liu et al. | |
| 7,812,511 | B2 | 10/2010 | Liu et al. | |
| 7,997,950 | B2 | 8/2011 | Wei et al. | |
| 2002/0055010 | A1 * | 5/2002 | Gao et al. | 428/607 |
| 2003/0012721 | A1 | 1/2003 | Nakayama et al. | |
| 2007/0145878 | A1 * | 6/2007 | Liu et al. | 313/336 |
| 2007/0237952 | A1 | 10/2007 | Jiang et al. | |
| 2008/0012466 | A1 | 1/2008 | Yang et al. | |
| 2008/0170982 | A1 * | 7/2008 | Zhang et al. | 423/447.3 |
| 2008/0254675 | A1 | 10/2008 | Lee et al. | |
| 2009/0085457 | A1 * | 4/2009 | Lin et al. | 313/310 |
| 2009/0115306 | A1 * | 5/2009 | Wei et al. | 313/309 |
| 2009/0134772 | A1 * | 5/2009 | Wei et al. | 313/495 |
| 2009/0194313 | A1 | 8/2009 | Jiang et al. | |
| 2009/0197082 | A1 | 8/2009 | Jiang et al. | |
| 2009/0255706 | A1 | 10/2009 | Jiang et al. | |
| 2009/0301993 | A1 | 12/2009 | Feng et al. | |
| 2010/0055338 | A1 * | 3/2010 | Kim et al. | 427/430.1 |
| 2010/0124622 | A1 | 5/2010 | Wang et al. | |

FOREIGN PATENT DOCUMENTS

| | | | |
|---|---|---|---|
| CN | 1877774 | A | 12/2006 |
| CN | 1959911 | | 5/2007 |
| CN | 101086939 | | 12/2007 |
| CN | 101097829 | | 1/2008 |
| CN | 101286383 | A | 10/2008 |
| CN | 101425435 | | 5/2009 |

(Continued)

*Primary Examiner* — Anh Mai
*Assistant Examiner* — Fatima Farokhrooz
(74) *Attorney, Agent, or Firm* — Altis & Wispro Law Group, Inc.

(57) ABSTRACT

A pixel tube for field emission display includes a sealed container, an anode, a phosphor, and a cathode. The sealed container has a light permeable portion. The anode is located in the sealed container and spaced from the light permeable portion. The phosphor layer is located on the anode. The cathode is spaced from the anode and includes a cathode emitter. The cathode emitter includes a carbon nanotube pipe. One end of the carbon nanotube pipe has a plurality of carbon nanotube peaks.

20 Claims, 18 Drawing Sheets

(56) References Cited

FOREIGN PATENT DOCUMENTS

| | | | |
|---|---|---|---|
| CN | 101499328 | | 8/2009 |
| CN | 101499331 | A | 8/2009 |
| CN | 101556839 | A | 10/2009 |
| CN | 101597049 | A | 12/2009 |
| CN | 101764007 | A | 6/2010 |
| CN | 1988108 | | 9/2010 |
| JP | 2001-192204 | | 7/2001 |
| JP | 2008-523254 | | 7/2008 |
| JP | P2008-277077 | A | 11/2008 |
| JP | 2009-117367 | | 5/2009 |
| JP | 2010188493 | A | 9/2010 |
| TW | 200722368 | | 6/2007 |
| TW | 201022140 | | 6/2010 |

* cited by examiner

FIELD EMISSION UNIT AND PIXEL TUBE FOR FIELD EMISSION DISPLAY

CROSS-REFERENCE TO RELATED APPLICATIONS

This application claims all benefits accruing under 35 U.S.C. §119 from China Patent Application No. 201010564731.0, filed on Nov. 29, 2010 in the China Intellectual Property Office, the disclosure of which is incorporated herein by reference. This application is related to applications entitled, "PIXEL TUBE FOR FIELD EMISSION DISPLAY", filed Dec. 30, 2010 Ser. No. 12/981,546; and "FIELD EMISSION UNIT AND PIXEL TUBE FOR FIELD EMISSION DISPLAY", filed Dec. 30, 2010 Ser. No. 12/981,578.

BACKGROUND

1. Technical Field

The present disclosure relates to a pixel tube for field emission display.

2. Description of Related Art

Field emission displays (FEDs) are based on the emission of electrons in a vacuum. Electrons are emitted from micron-sized tips in a strong electric field, the electrons are accelerated to collide with a fluorescent material, which then emits visible light. Field emission displays are thin, light weight, and provide high levels of brightness.

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). Carbon nanotubes also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make carbon nanotubes ideal candidates for electron emitter in field emission displays. Generally, a carbon nanotube wire drawn from a carbon nanotube array is used as an electron emitter after being cut by a blade. However, because the carbon nanotube wire has a planar end surface and low electron emission efficiency, the luminous efficiency of the field emission display is low.

What is needed, therefore, is to provide a high luminous efficiency pixel tube for field emission display.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present pixel tube for field emission display.

Figure 1:
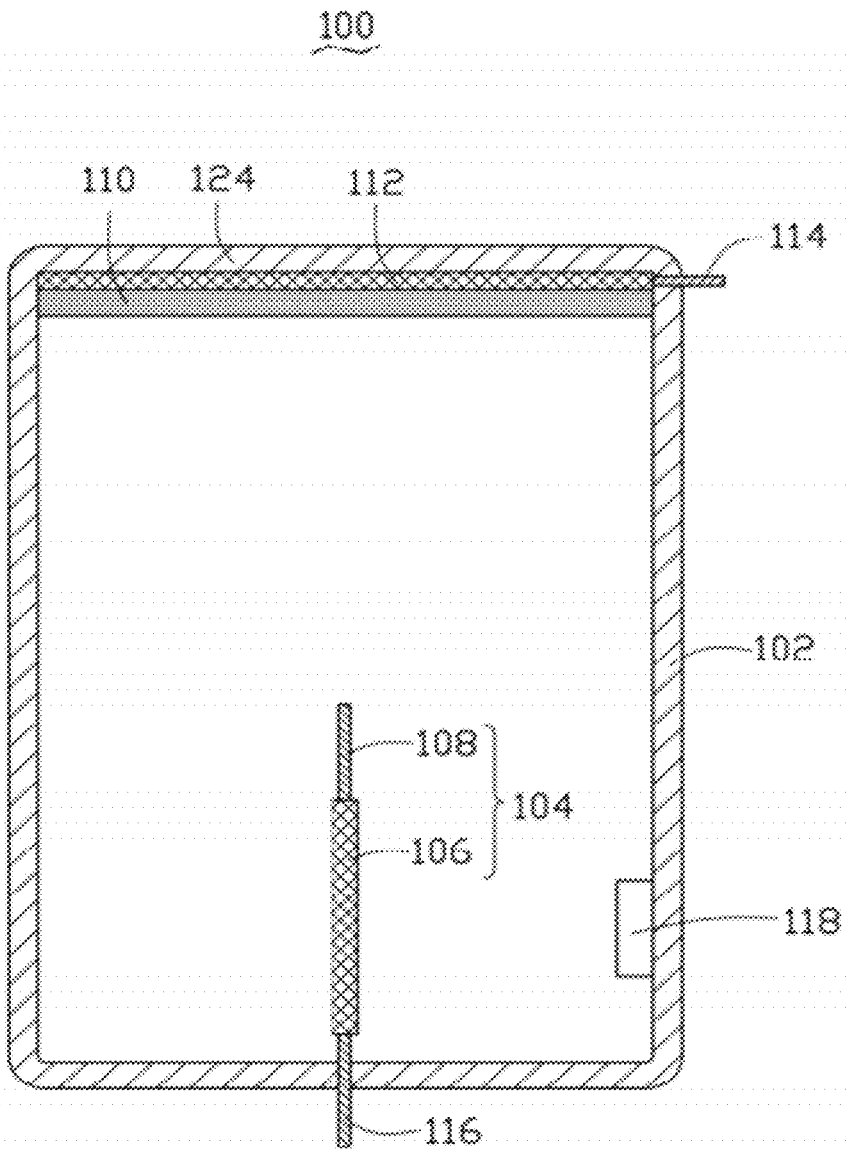
FIG. 1 is a schematic view of one embodiment of a pixel tube.

Referring to FIG. 1, a pixel tube 100 of one embodiment includes a sealed container 102, a cathode 104, a phosphor layer 110, an anode 112, a cathode terminal 116, and an anode terminal 114.

The sealed container 102 defines a vacuum space to accommodate the cathode 104, the phosphor layer 110, and the anode 112. The cathode 104 and the anode 112 are spaced from each other. The cathode terminal 116 is electrically connected to the cathode 104 and extends from the inside to the outside of the sealed container 102. The anode terminal 114 is electrically connected to the anode 112 and extends from the inside to the outside of the sealed container 102. When a voltage is applied between the anode 112 and the cathode 104, a number of electrons can be emitted from the cathode 104. The electrons can strike the phosphor layer 110 to luminesce under the electric field force of the anode 112. Thus, the pixel tube 100 lights.

The sealed container 102 includes a plurality of walls and defines an inner space in vacuum. At least one wall of the container 102 can be used as a light permeable portion 124. The light permeable portion 12 can have a planar surface, a spherical surface, or an aspheric surface. The sealed container 102 can be made of insulative material such as quartz or glass. The shape of the sealed container 102 can be a cube, polyhedron, cylinder, prism, hemisphere, or sphere. In one embodiment, the sealed container 102 has a substantially cylindrical shape and a side wall, a top wall, and a bottom wall. The top wall is used as the light permeable portion 124. The diameter of the sealed container 102 can be in a range from about 1 millimeter to about 10 millimeters. The length of the sealed container 102 can be in a range from about 2 millimeters to about 50 millimeters.

The anode 112 is located on an inner surface of the light permeable portion 124. The anode 112 can be a transparent conductive layer such as an indium tin oxide (ITO) film, a carbon nanotube film, or an aluminum film. The thickness and area of the anode 112 can be selected according to need. In one embodiment, the anode 112 is an aluminum film.

The phosphor layer 110 can be located on the anode 112 oriented to the cathode 104, or between the anode 112 and the light permeable portion 124. The phosphor layer 110 can be white phosphor or color phosphor such as red phosphor, green phosphor, or blue phosphor. The thickness and area of the phosphor layer 110 can be selected according to need. The phosphor layer 110 can be formed by deposition or coating. In one embodiment, the phosphor layer 110 is a white phosphor layer having thickness in a range from about 5 micrometers to about 50 micrometers.

The cathode 104 is located on the wall oriented to the light permeable portion 124. The cathode 104 is substantially perpendicular to the light permeable portion 124 and in alignment with an axis of the container 102. The cathode 104 includes a cathode support 106 and a cathode emitter 108 electrically connected to the cathode support 106. The cathode emitter 108 can be fixed on the cathode support 106 by a conductive paste, such as silver paste. The cathode emitter 108 includes an electron emission portion pointing to the light permeable portion 124. The cathode support 106 is electrically connected to the cathode terminal 116. The cathode support 106 can be an electrical and thermal conductor such as a metal wire. In one embodiment, the cathode support 106 is a copper wire or nickel wire. Furthermore, the cathode 104 can include a number of cathode emitters 108 electrically connected to the cathode support 106 and spaced from each other.

Figure 2:
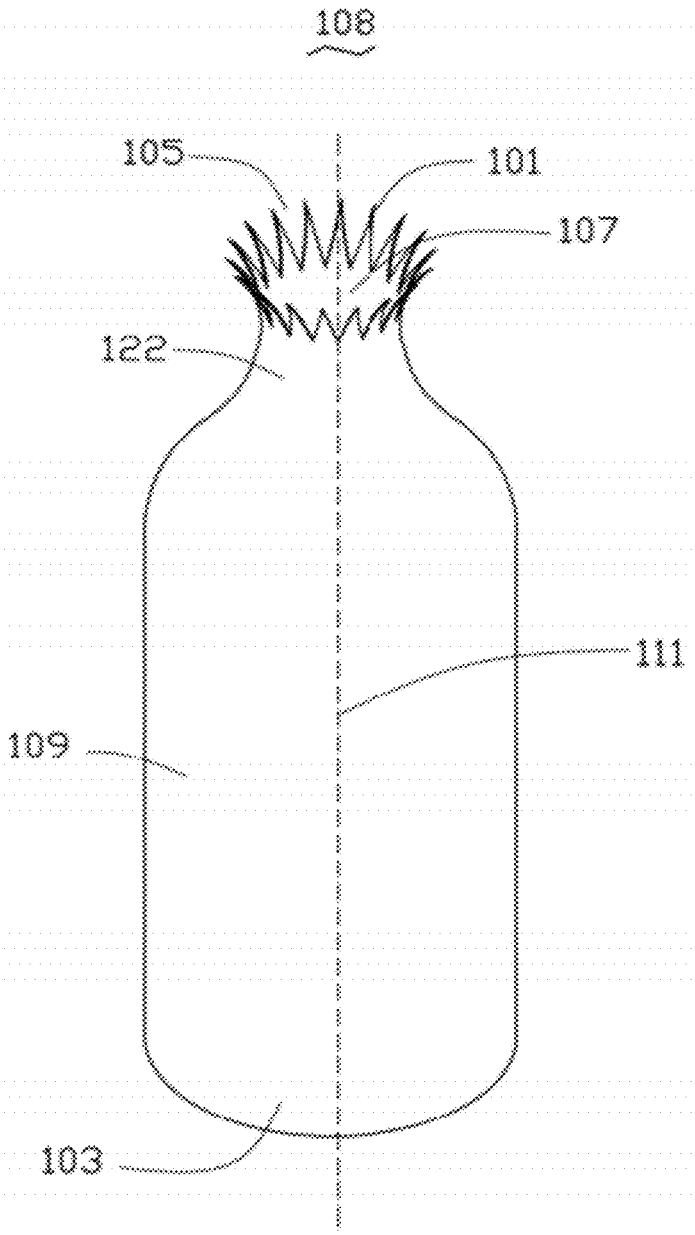
FIG. 2 is a schematic view of one embodiment of a carbon nanotube pipe.
Figure 3:
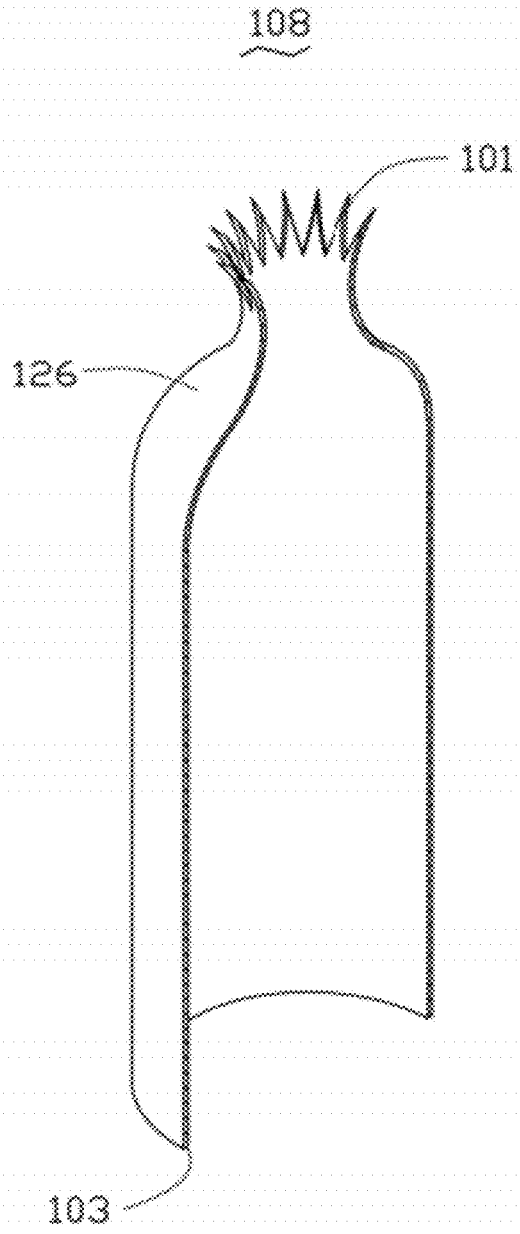
FIG. 3 is a schematic, cross-sectional view, along an axial direction of FIG. 2.
Figure 4:
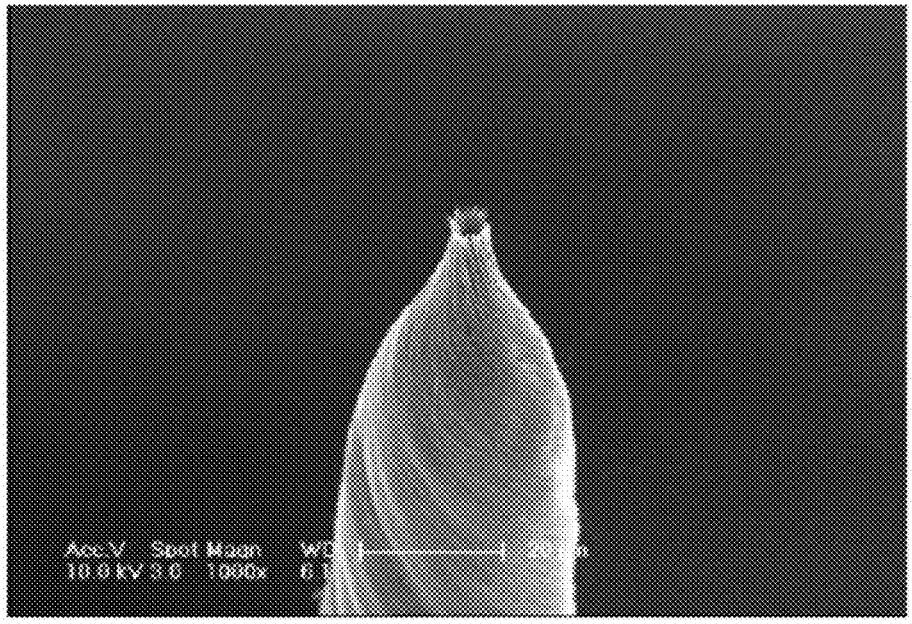
FIG. 4 is a Scanning Electron Microscope (SEM) image of one embodiment of a carbon nanotube pipe.

Referring to FIGS. 2 to 4, the cathode emitter 108 includes a carbon nanotube pipe. The length of the carbon nanotube pipe can be selected according to need. The cross section of the carbon nanotube pipe can be circular, ellipsoid, quadrangular, triangular, or polygonal. The carbon nanotube pipe includes a number of carbon nanotubes joined by van der Waals force. In one embodiment, the carbon nanotube pipe includes a number of successive and oriented carbon nanotubes. Most of the carbon nanotubes are helically oriented around an axis 111 of the carbon nanotube pipe. The carbon nanotube pipe may have a few carbon nanotubes not helically oriented around the axis 111, but oriented disorderly and randomly. The helically oriented carbon nanotubes are joined end-to-end by van der Waals force therebetween along a helically extending direction. The angle between the helically extending direction and the axis 111 can be greater than 0 degrees and less than or equal to 90 degrees. In one embodiment, the angle between the helically extending direction and the axis 111 can be in a range from about 30 degrees to about 60 degrees.

Figure 5:
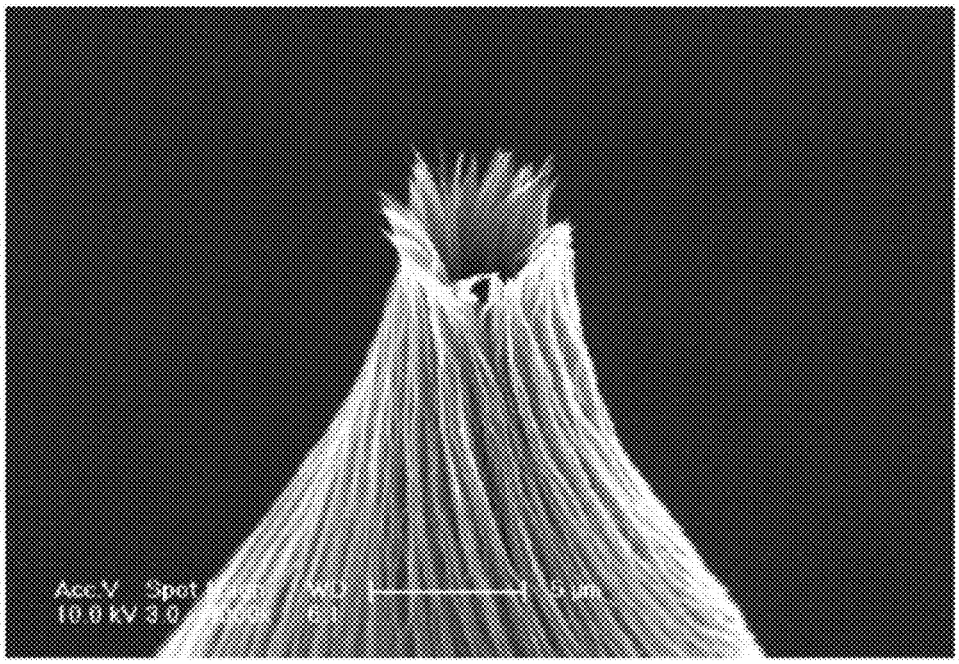
FIG. 5 is a SEM image of one embodiment of one end of a carbon nanotube pipe.
Figure 6:
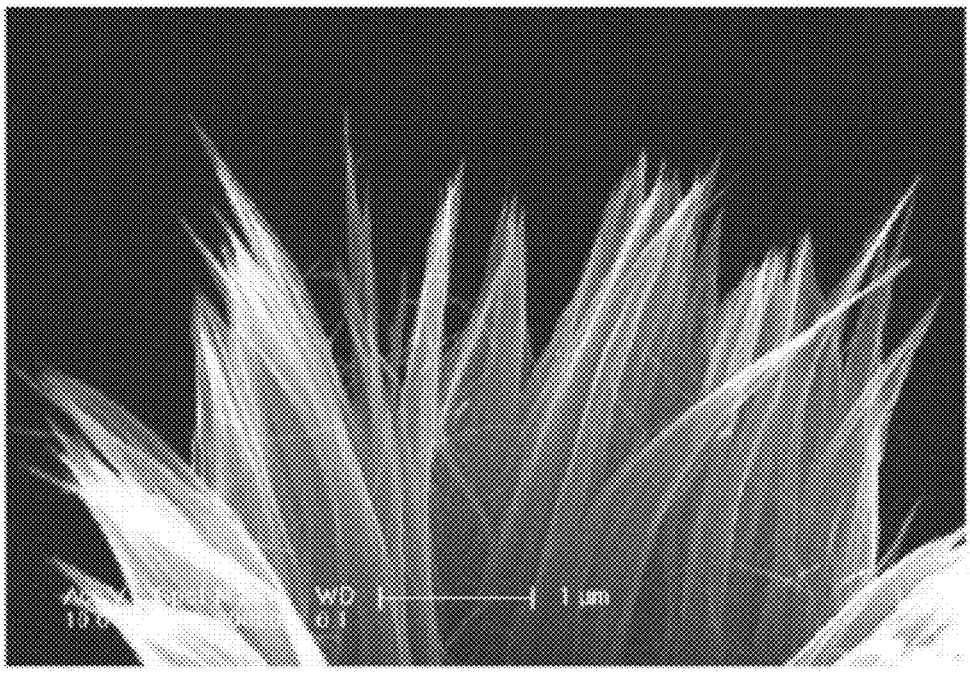
FIG. 6 is a SEM image of one embodiment of carbon nanotube peaks at one end of a carbon nanotube pipe.

Referring also to FIGS. 5 and 6, the cathode emitter 108 is a carbon nanotube pipe including a first end 103, a second end 105 oriented to the first end 103, and a main body 109 connecting the first end 103 and the second end 105. The first end 103 is fixed on the cathode support 106, and the second end 105 extends from the cathode support 106 toward the light permeable portion 124. The second end 105 is used as an electron emission portion. The second end 105 defines an opening 107 and includes a hollow neck portion 126 connected to the main body 109. A number of carbon nanotube peaks 101 extend from a top of the neck portion 126 to enclose the opening 107. The diameter of the hollow neck portion 126 gradually diminishes along a direction apart from the first end 103 and forms a substantially conical shape. The carbon nanotube peaks 101 are located around the axis 111 of the carbon nanotube pipe and spaced from each other to form a ring shape. Each of the carbon nanotube peaks 101 is a tapered carbon nanotube bundle pointing to the anode 112 and functions as an electron emitter. The carbon nanotube peaks 101 can extend along a same direction substantially parallel with the axis 111. The carbon nanotube peaks 101 can also extend along different directions across the axis 111 to form a radial shape. If the carbon nanotube peaks 101 form a radial shape, the size of the opening 107 of the second end 105 gradually increases where the neck portion 126 connects to the carbon nanotube peaks 101. The distance between two adjacent carbon nanotube peaks 101 gradually increases. Thus, the screening effect between the carbon nanotube peaks 101 is reduced. The effective diameter of the opening 107 where the neck portion 126 connects with the carbon nanotube peaks 101 can be in a range from about 4 micrometers to about 6 micrometers. In one embodiment, the opening 107 is round and has a diameter of about 5 micrometers.

Figure 7:
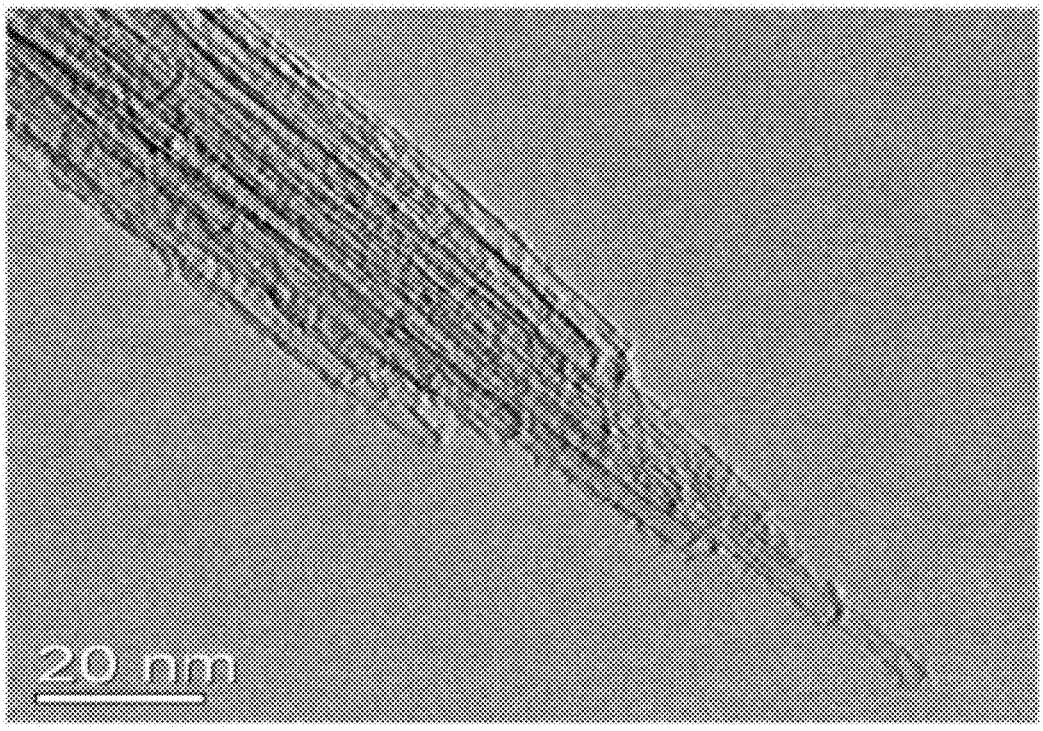
FIG. 7 is a Transmission Electron Microscope (TEM) image of one embodiment of a carbon nanotube peak.

Further referring to FIG. 7, the carbon nanotube peak 101 includes a number of carbon nanotubes substantially parallel to each other and joined by van der Waals force. A single projecting carbon nanotube is taller than and projects over other carbon nanotubes in the carbon nanotube peak 101. The single projecting carbon nanotube can be located within the middle of the other carbon nanotubes. The diameter of the carbon nanotubes is less than 5 nanometers, and the number of graphite layers of each carbon nanotubes is about 2 to 3. In one embodiment, the diameter of the carbon nanotubes is less than 4 nanometers. The distance of the projecting carbon nanotubes of two adjacent carbon nanotube peaks 101 can be in a range from about 0.1 micrometers to about 2 micrometers. The ratio of the distance between the projecting carbon nanotubes and the diameter of the carbon nanotubes can be in a range from about 20:1 to about 500:1. Because the distance between the projecting carbon nanotubes is much greater than the diameter of the carbon nanotubes, the screening effect between the projecting carbon nanotubes is reduced.

The main body 109 of the carbon nanotube pipe can be formed by closely wrapping a carbon nanotube film or a carbon nanotube wire around the axis 111. The carbon nanotube film or carbon nanotube wire can be wrapped layer upon layer. The thickness of the wall of the main body 109 can be determined by the number of the layers. The inner diameter and outer diameter of the main body 109 can be selected according to need. The inner diameter of the carbon nanotube pipe can be in a range from about 10 micrometers to about 30 micrometers. The outer diameter of the carbon nanotube pipe can be in a range from about 15 micrometers to about 60 micrometers. In one embodiment, the inner diameter of the main body 109 is about 18 micrometers, and the outer diameter of the main body 109 is about 50 micrometers.

Figure 8:
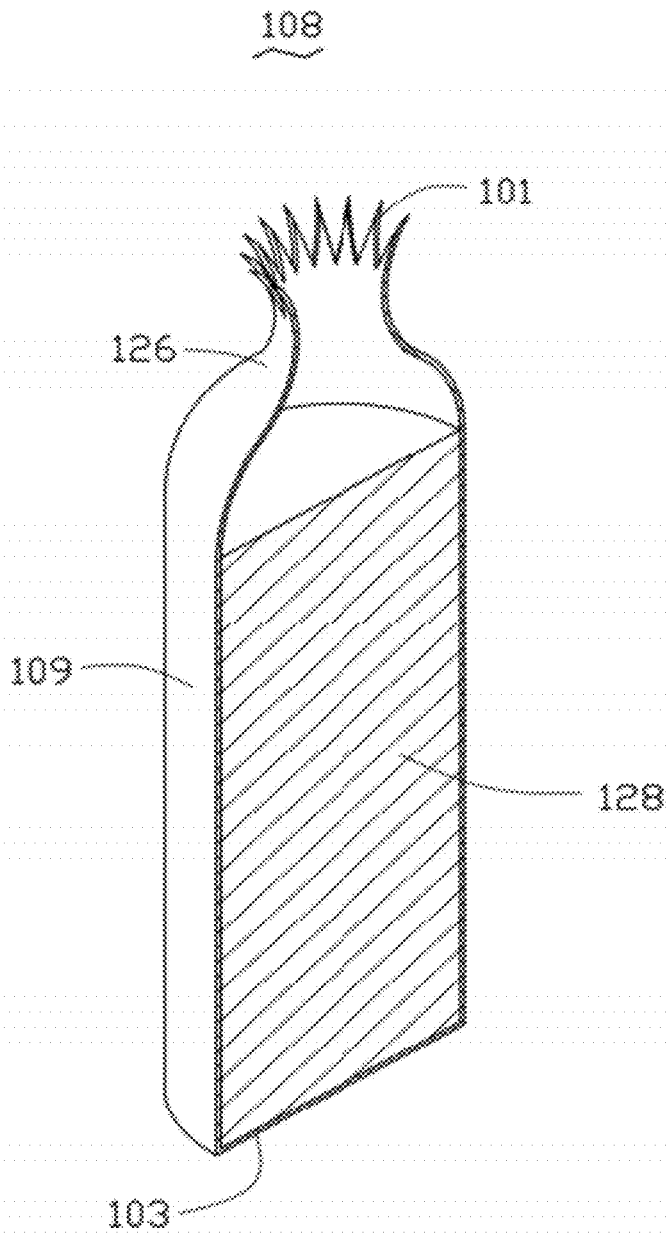
FIG. 8 is a schematic view of one embodiment of a carbon nanotube pipe and a linear support.

Referring to FIG. 8, the cathode emitter 108 can further include a linear support 128 located in the carbon nanotube pipe to form a carbon nanotube composite. The linear support 128 is encased by the carbon nanotube pipe. The length of the linear support 128 is shorter than that of the carbon nanotube pipe. In one embodiment, the linear support 128 can extend from the first end 103 to where the hollow neck portion 126 connects to the main body 109. The linear support 128 is configured to support the carbon nanotube pipe and improve the mechanical strength of the cathode emitter 108. The linear support 128 can be made of conductive material or insulative material. The diameter of the linear support 128 can be in a range from about 10 micrometers to about 30 micrometers. In one embodiment, the linear support 128 is a metal wire and can be used to electrically connect the carbon nanotube pipe to the cathode support 106. The linear support 128 can be wielded on the cathode support 106. The linear support 128 can also be a portion of the cathode support 106.

A method for making the cathode emitter 108 is provided. The method can include:

(S10) providing a linear structure;

(S20) providing a carbon nanotube film or wire;

(S30) wrapping the carbon nanotube film or wire around the linear structure;

(S40) removing the linear structure to obtain a carbon nanotube hollow cylinder; and (S50) cutting the carbon nanotube hollow cylinder.

In step (S10), the linear structure is configured to support the carbon nanotube film or wire and should have a certain strength and toughness. In addition, the linear structure should be easily removed by a chemical method, or a physical method. The material of the linear structure can be metal, alloy, or polymer. The metal can be gold, silver, copper, or aluminum. The alloy can be a copper-tin alloy. In one embodiment, the linear structure is a copper-tin alloy wire including about 97 wt. % copper and about 3 wt. % tin. Furthermore, the linear structure can be plated with a silver film.

In step (S20), the carbon nanotube film or wire can be made by following steps:

(S201) providing an carbon nanotube array; and (S202) pulling out a carbon nanotube film or wire from the carbon nanotube array.

In step (S201), a method of forming the carbon nanotube array includes:

(S2011) providing a substantially flat and smooth substrate;

(S2012) forming a catalyst layer on the substrate;

(S2013) annealing the substrate with the catalyst at a temperature in the approximate range of 700° C. to 900° C. in air for about 30 to 90 minutes;

(S2014) heating the substrate with the catalyst at a temperature in the approximate range from 500° C. to 740° C. in a furnace with a protective gas therein; and (S2015) supplying a carbon source gas to the furnace for about 5 to about 30 minutes and growing a super-aligned array of the carbon nanotubes from the substrate.

The carbon nanotube array can be approximately 200 to approximately 900 micrometers in height and includes a plurality of carbon nanotubes substantially parallel to each other and nearly perpendicular to the substrate. The carbon nanotubes can be single-walled carbon nanotubes, double-walled carbon nanotubes, or multi-walled carbon nanotubes. The carbon nanotube array formed under the above conditions is essentially free of impurities such as carbonaceous or residual catalyst particles. The carbon nanotubes in the carbon nanotube array are packed together closely by van der Waals force.

In step (S202), a carbon nanotube film or wire can be formed by the steps of:

(S2021) selecting one or more carbon nanotubes having a predetermined width from the carbon nanotube array; and (S2022) pulling the carbon nanotubes to form nanotube segments at an even/uniform speed to achieve an uniform carbon nanotube film or wire.

In step (S2021), the carbon nanotube segment includes a plurality of parallel carbon nanotubes. The carbon nanotube segments can be selected by using an adhesive tape as the tool to contact the carbon nanotube array.

In step (S2022), the pulling direction is substantially perpendicular to the growing direction of the carbon nanotube array. During the pulling process, as the initial carbon nanotube segments are drawn out, other carbon nanotube segments are also drawn out end to end due to van der Waals force between ends of adjacent segments. This process of pulling produces a substantially continuous and uniform carbon nanotube film having a predetermined width can be formed. The width of the carbon nanotube film depends on a size of the carbon nanotube array. If the carbon nanotube film is very small, the carbon nanotube wire can be obtained. The length of the carbon nanotube film can be set as desired.

The carbon nanotube film or wire includes a plurality of successively oriented carbon nanotube segments joined end-to-end by van der Waals force therebetween. Each carbon nanotube segment includes a plurality of carbon nanotubes substantially parallel to each other, and combined by van der Waals force therebetween. Some variations can occur in the drawn carbon nanotube film or wire. The carbon nanotubes in the drawn carbon nanotube film or wire are oriented along a preferred orientation.

Furthermore, the carbon nanotube film can be treated by applying organic solvent to the carbon nanotube film or twisting to form a carbon nanotube wire.

The step (S30) can include the following steps:

(S301) adhering one end of the carbon nanotube film or wire to the linear structure; and (S302) making a relative rotation between the linear structure and the carbon nanotube film or wire, and simultaneously moving the linear structure along an axial direction of the linear structure.

In step (S302), the extending direction of the carbon nanotubes in the film or wire and the axial direction of the linear structure can be greater than 0 degrees and less than 90 degrees.

The step (S40) can be performed by a chemical method, or a physical method, such as a mechanical method. If the linear structure is made of an active metal or an alloy composed of active metals, such as iron, aluminum, or an alloy thereof, the step (S40) can be performed by reacting with an acid liquid. If the material of the linear structure is an inactive metal or an alloy including inactive metals, such as gold, silver, or an alloy thereof; the step (S40) can be performed by heating to evaporate. If the material of the linear structure is a polymer material, the step (S40) can be performed by pulling the linear structure out using a stretching device along the axial direction of the linear structure. Therefore, the shape and the effective diameter of the linear structure can decide the figure and effective inner diameter of the carbon nanotube hollow cylinder. In one embodiment, the linear structure is an aluminum wire and removed by dissolving in a solution of about 0.5 mol/L hydrochloric acid.

Figure 9:
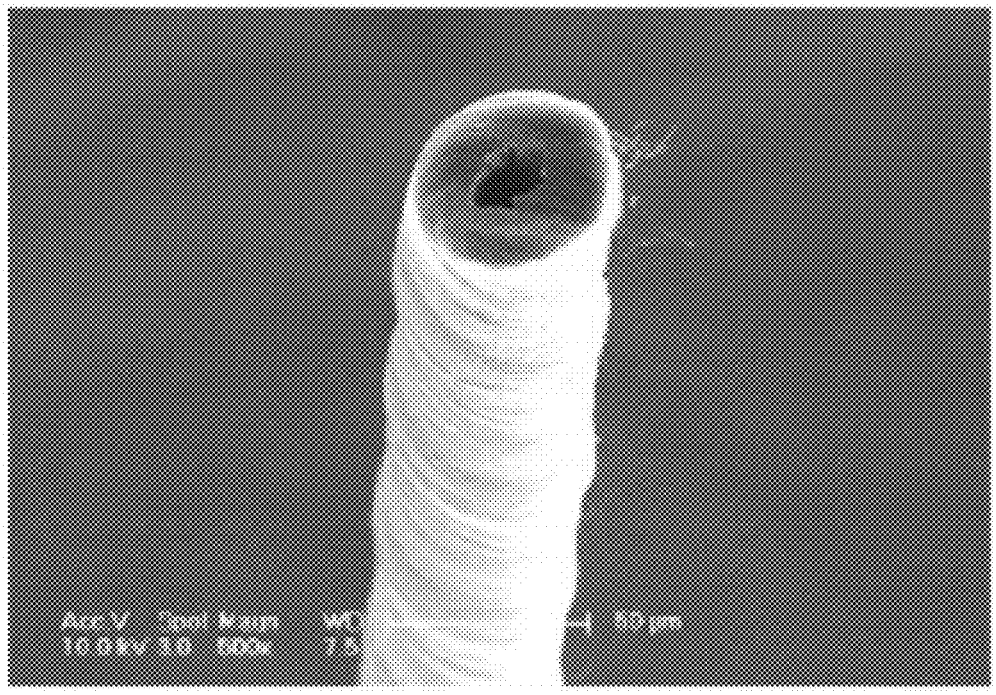
FIG. 9 is a SEM image of one embodiment of a carbon nanotube hollow cylinder.

Referring to FIG. 9, the carbon nanotube hollow cylinder includes a number of successive and oriented carbon nanotubes. Most of the carbon nanotubes are helically oriented around an axial direction of the carbon nanotube hollow cylinder. The helically oriented carbon nanotubes are joined end-to-end by van der Waals force therebetween along a helically extending direction. The carbon nanotube hollow cylinder may have a few carbon nanotubes not helically oriented around the axial direction, but oriented disorderly and randomly.

In step (S50), the carbon nanotube hollow cylinder can be cut by laser scanning, electron beam irradiation, ion beam irradiation, heating by supplying a current, and/or laser-assisted fusing after supplying current.

In one embodiment, step (S50) includes (S501) placing the carbon nanotube hollow cylinder in a chamber; and (S502) supplying a voltage between two opposite ends of the carbon nanotube hollow cylinder.

In step (S501), the chamber can be a vacuum or filled with an inert gas. The vacuum can be less than $1\times10^{-3}$ Pascal (Pa). In one embodiment, the vacuum of the chamber is about $2\times10^{-5}$ Pa. The chamber includes an anode and a cathode therein, which lead from inside to outside of the chamber. One end of the carbon nanotube hollow cylinder is electrically connected to the anode, and the other one end is electrically connected to the cathode.

In step (S502), a voltage is supplied between the anode and the cathode to heat the carbon nanotube hollow cylinder. The voltage depends on the inner diameter, outer diameter, and the length of the carbon nanotube hollow cylinder. In one embodiment, the carbon nanotube hollow cylinder is about 2 centimeters in length, about 25 micrometers in the inner diameter, and about 40 micrometers in the outer diameter, and a 40 V direct current (DC) voltage applied. After a while, the carbon nanotube hollow cylinder snaps at a certain point to form two carbon nanotube pipes. Each carbon nanotube pipe has broken end.

When the voltage is applied to the carbon nanotube hollow cylinder, a current flows through the carbon nanotube hollow cylinder. Consequently, the carbon nanotube hollow cylinder is heated by Joule-heating. The temperature of the carbon nanotube hollow cylinder can reach a range from about 2000 Kelvin (K) to about 2400 K. The resistance at different points along the axial direction of the carbon nanotube hollow cylinder is different, and thus the temperature distribution along the axial direction of the carbon nanotube hollow cylinder is different. The greater the resistance, the higher the temperature, and the easier it snaps. The carbon nanotube hollow cylinder is snapped at a point having the greatest resistance. The heating time is less than 1 hour.

During snapping, some carbon atoms vaporize from the snapping portion of the carbon nanotube hollow cylinder. After snapping, a micro-fissure is formed between the two broken ends, arc discharge may occur between the micro-fissure, and the carbon atoms are transformed into carbon ions due to ionization. These carbon ions bombard or etch the broken ends to form a number of carbon nanotube peaks 101. A wall by wall breakdown of carbon nanotubes is caused by the Joule-heating at a temperature higher than 2000K. The carbon nanotubes at the broken ends have smaller diameters and a fewer number of graphite layers.

In one embodiment, a step (S503) of irradiating the carbon nanotube hollow cylinder by an electron beam can be performed after step (S502). With electron beam bombarding, a temperature of the predetermined point is enhanced, and thus the temperature thereof is higher than the other points. Thus, the carbon nanotube hollow cylinder can be snapped quickly at a predetermined point. In step (S503), an electron emitter can be used to produce an electron beam and bombard a predetermined point of the carbon nanotube hollow cylinder. When step (S503) is performed, the vacuum of the chamber can be less than $1\times10^{-4}$ Pa.

In one embodiment, a step (S504) of irradiating the carbon nanotube hollow cylinder by a laser can be performed before step (S501), after step (S501) or step (S502). With the laser irradiating, a defect can be introduced at a predetermined point of the carbon nanotube hollow cylinder. The temperature of the predetermined point having the defect increases faster than the other points. Thus, the carbon nanotube hollow cylinder can be snapped quickly at a predetermined point. The power of the laser can be in a range from about 1 W to about 60 W, and the speed of the laser movement can be in a range from about 100 millimeters per second to about 2000 millimeters per second.

If the material of the linear structure is an inactive metal or an alloy including inactive metals, the step (S40) can be omitted, and step (S50) can be performed directly after step (S30). During snapping, the linear structure near the snapping point is heated to vaporize. Thus, the cathode emitter 108 of FIG. 8 can be obtained.

Figure 10:
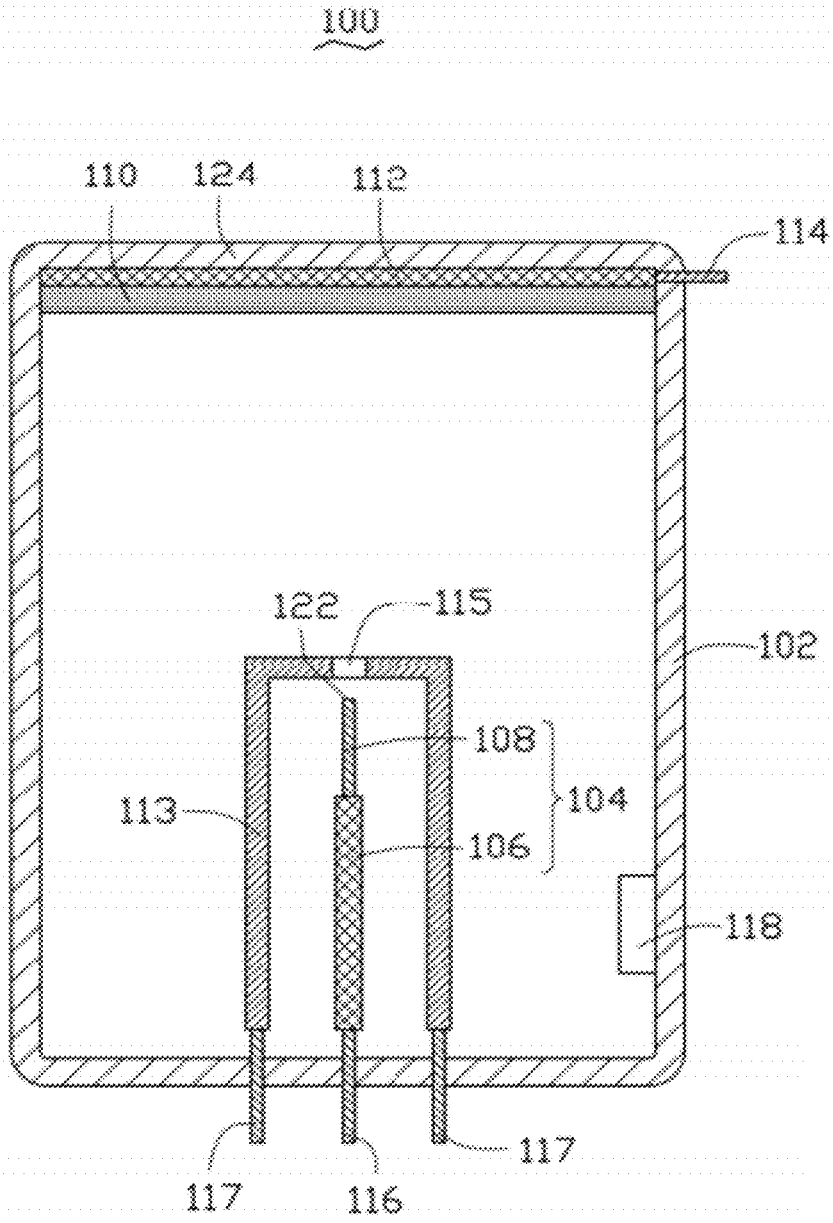
FIG. 10 is a schematic view of one embodiment of a pixel tube.

Referring to FIG. 10, the pixel tube 100 can further include a gate electrode 113 on a wall of the container 102. The gate electrode 113 can be a canister including a side wall and a top wall connecting to a top end of the side wall so the cathode 104 is enclosed by the gate electrode 113 incorporating with a part of the wall of the container 102. The top wall defines an opening 115 as an output portion. The electron emission portion 122 is oriented to the opening 115. The shape of the gate electrode 113 can be the same as that of the sealed container 102. In one embodiment, the gate electrode 113 is a metal canister and spaced from the cathode 104 and anode 112. The gate electrode 113 is electrically connected to a gate electrode terminal 117 which extends from the inside to the outside of the sealed container 102. The gate electrode 113 can be used to supply a lower working voltage causing the cathode emitter 108 to emit electrons and prevent the cathode emitter 108 from being damaged by the high electric field of the anode 112.

Furthermore, the pixel tube 100 can include a getter 118 configured for absorbing residual gas inside the sealed container 102 and maintaining the vacuum in the inner space of the sealed container 102. The getter 118 can be arranged on an inner surface of the sealed container 102. The getter 118 can be an evaporable getter formed on the inner surface of the sealed container 102 using high frequency heating or a non-evaporable getter attached on the inner surface of the sealed container 102 directly. The non-evaporable getter can be made of titanium, zirconium, hafnium, thorium, rare earth metals, or alloys thereof.

In use, a high voltage is supplied to the anode 112, a low voltage is supplied to the gate electrode 113, and the cathode 104 is grounded. The cathode emitter 108 can emit electrons under the electric field force of the gate electrode 113. The electrons can strike the phosphor layer 110 to luminesce under the electric field force of the anode 112. Thus, the pixel tube 100 lights. A number of the pixel tubes 100 can be arranged in an array to form a field emission display.

Figure 11:
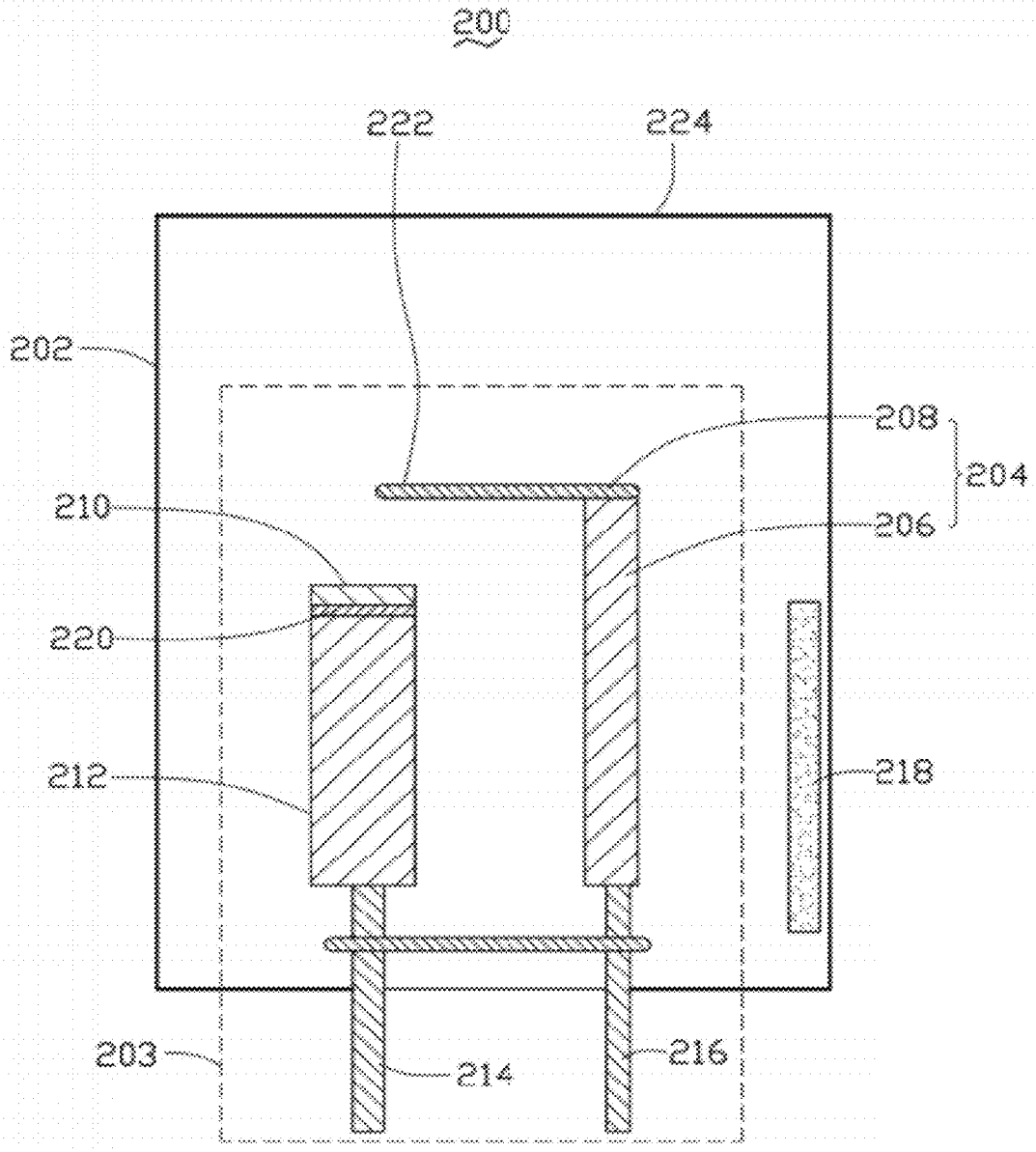
FIG. 11 is a schematic view of one embodiment of a pixel tube.

Referring to FIG. 11, a pixel tube 200 of one embodiment includes a sealed container 202 having a light permeable portion 224, a cathode 204 including a cathode support 206 and a cathode emitter 208, a phosphor layer 210, an anode 212, a cathode terminal 216, an anode terminal 214, and a getter 218. The pixel tube 200 is similar to the pixel tube 100 described above except that the anode 212 is spaced from the light permeable portion 224, has an end surface 220 oriented to the light permeable portion 224, and the phosphor layer 210 is located on the end surface 220.

Figure 12:
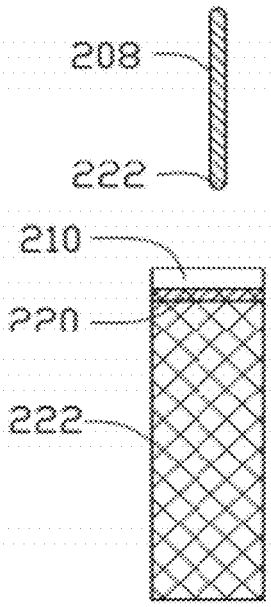
FIGS. 12 to 15 are schematic views showing different position relationships between a cathode emitter and a phosphor layer.
Figure 13:
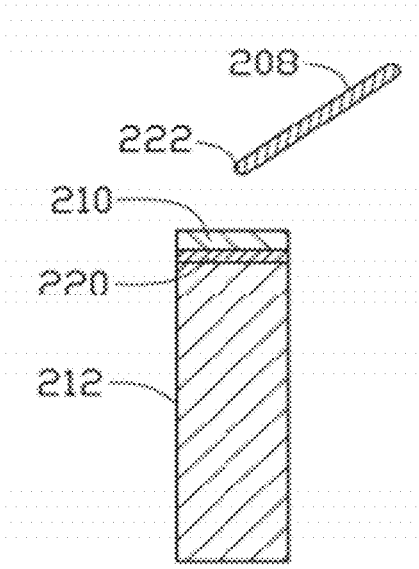
Figure 14:
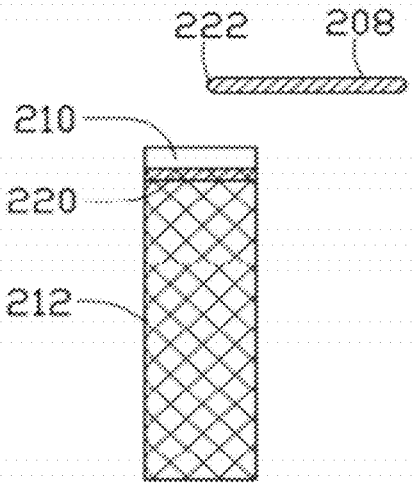
Figure 15:
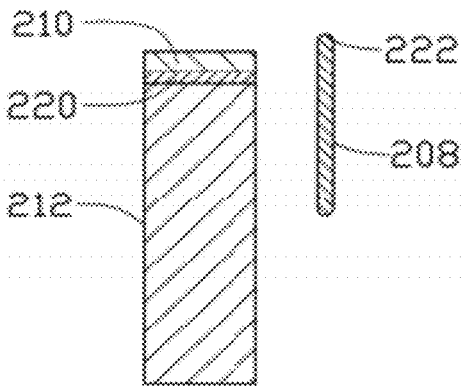

The cathode 204, the phosphor layer 210, the anode 212, the cathode terminal 216, and the anode terminal 214 can be used as a field emission unit 203. In one embodiment, the anode 212 and the cathode support 206 each have a post configuration and are located substantially parallel to each other. The cathode emitter 208 is electrically connected to the cathode support 206 and extends from the cathode support 206 to the phosphor layer 210. The cathode emitter 208 includes an electron emission portion 222 located adjacent to spaced from and oriented to the phosphor layer 210. Referring to FIGS. 12 to 14, the cathode emitter 208 can be arranged substantially perpendicular to the surface of the phosphor layer 210, substantially parallel to the surface of the phosphor layer 210, or inclined to the surface of the phosphor layer 210 sat a certain angle so that an orthographic projection of the emission portion 222 can be on the surface of the phosphor layer 210. Referring to FIG. 15, the cathode emitter 208 can also be arranged substantially parallel to the anode 212 so that the emission portion 222 is adjacent to the phosphor layer 210. The distance between the emission portion 222 and the surface of the phosphor layer 210 can be in range from about 0.5 millimeters to about 3 millimeters.

The anode 212 can be an electrical and thermal conductor such as a metal post. The shape of the anode 212 can be selected according to need. In one embodiment, the anode 212 is a copper post having a diameter in a range from about 100 micrometers to about 3 millimeters. The end surface 220 can be a polished metal surface or a plated metal surface that can reflect the light beams emitted from the phosphor layer 210 to the light permeable portion 214 to enhance the brightness of the pixel tube 200. The end surface 220 can be a planar or curved surface such as a hemispherical, spherical, or conical surface. In one embodiment, the end surface 220 is a polished plane at the end of the copper post.

Figure 16:
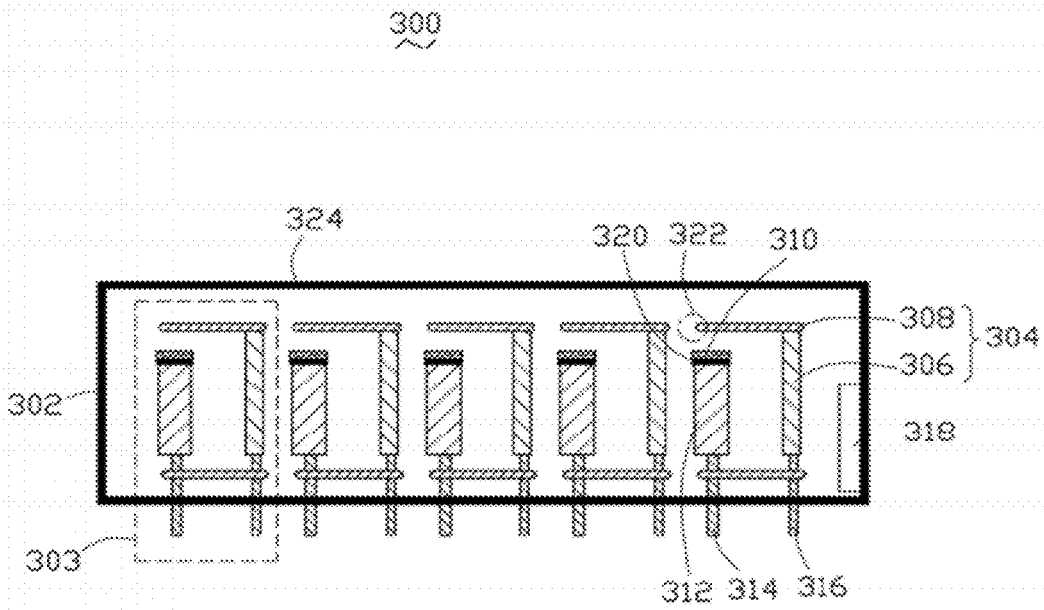
FIG. 16 is a schematic view of one embodiment of a pixel tube.

Referring to FIG. 16, a pixel tube 300 of one embodiment includes a sealed container 302 having a light permeable portion 324, a number of field emission units 303 located in the sealed container 302, and a getter 318. Each field emission unit 303 includes a cathode 304. The cathode 304 includes a cathode support 306, a cathode emitter 308, an anode 312 having an end surface 322, a phosphor layer 310 located on the end surface 322, a cathode terminal 316, and an anode terminal 314. The pixel tube 300 is similar to the pixel tube 200 described above except that the pixel tube 300 includes a number of field emission units 303 spaced from each other.

The field emission units 303 can be arranged to form a line or an array. In one embodiment, the sealed container 302 is a hollow cylinder, and the field emission units 303 are substantially equidistantly arranged along a lengthwise direction of the sealed container 302. A drive circuit independently controls the field emission units 303. The pixel tube 300 can be used as a field emission display or to assemble a large screen field emission display. Because a number of field emission units 303 are disposed in the sealed container 302, the manufacturing process is simple and the cost is low.

Figure 17:
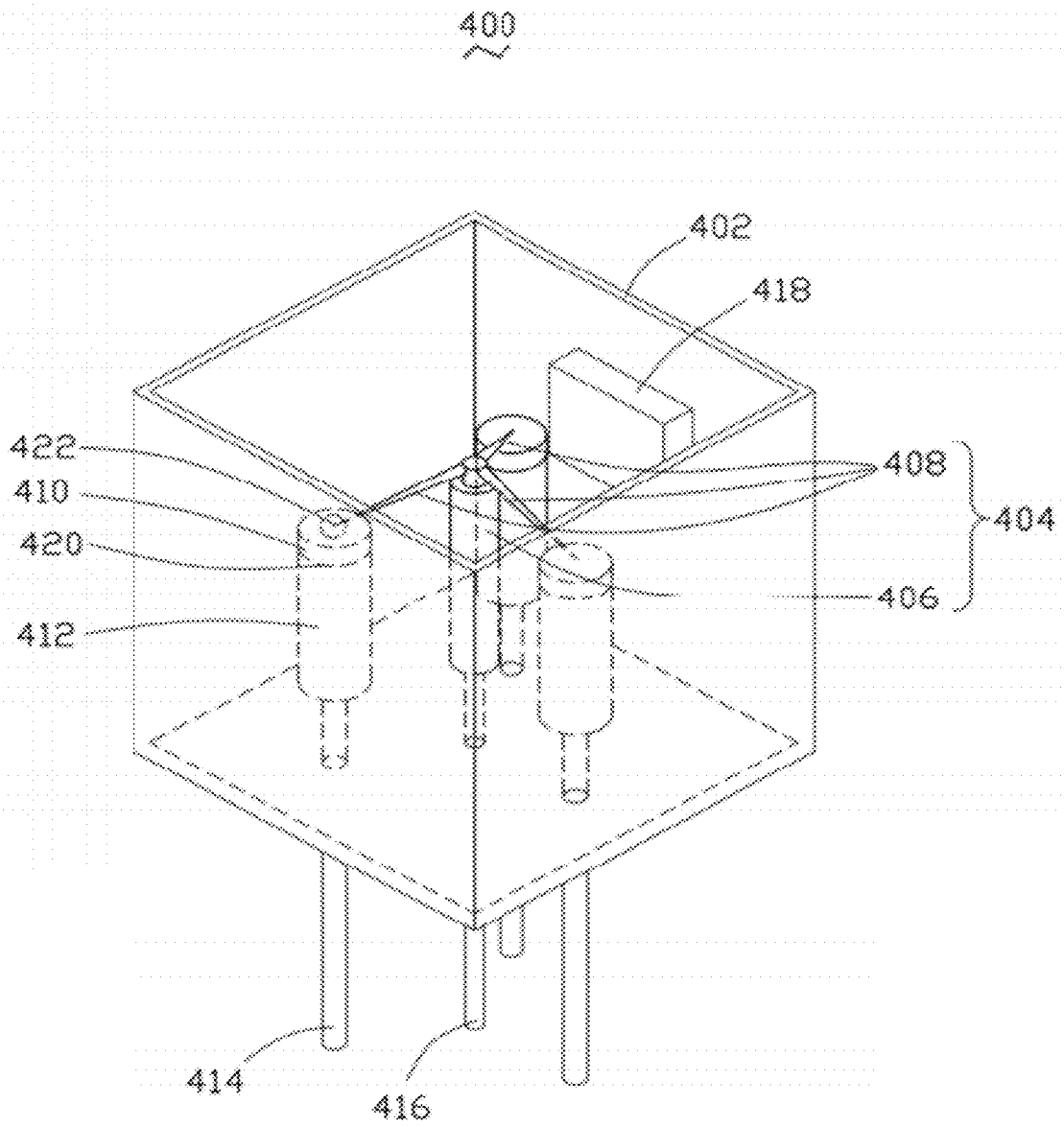
FIG. 17 is a schematic view of one embodiment of a pixel tube.
Figure 18:
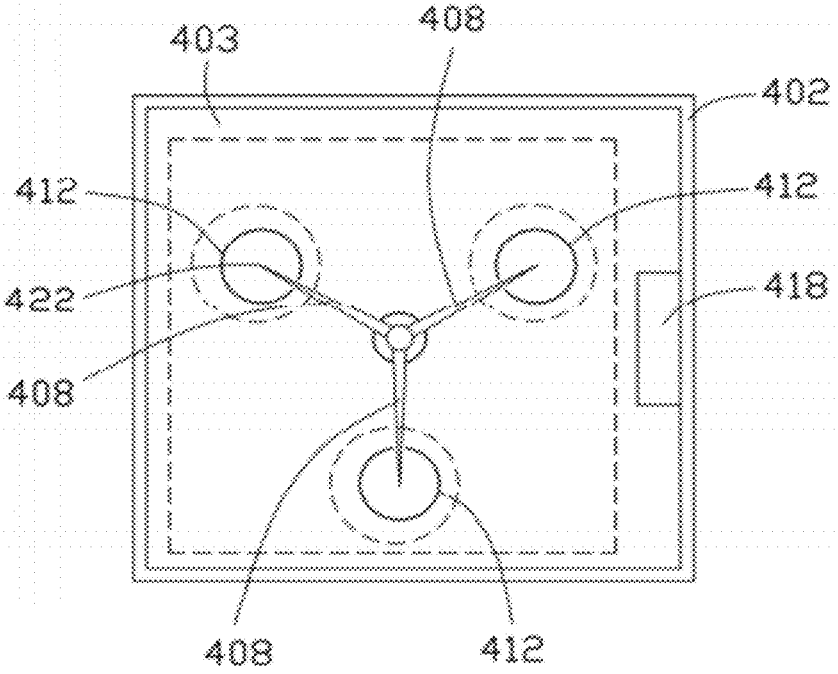
FIG. 18 is a schematic top view of the pixel tube of FIG. 17.

Referring to FIGS. 17 to 18, a pixel tube 400 of one embodiment includes a sealed container 402, at least one field emission unit 403 located in the sealed container 402, and a getter 418. The pixel tube 400 is similar to the pixel tube 200 described above except that each field emission unit 403 includes a cathode 404 including a number of cathode emitters 408, a number of anodes 412, a number of phosphor layers 410, a cathode terminal 416, and a number of anode terminals 414.

In one embodiment, the pixel tube 400 includes only one field emission unit 403. The field emission unit 403 includes a cathode 404 including a cathode support 406 and three cathode emitters 408, a cathode terminal 416, three anodes 412, three phosphor layers 410, and three anode terminals 414. The three anodes 412 are located around the cathode support 406 so that the orthographic projection of the three anodes 412 forms a triangle. In one embodiment, the triangle is an equilateral triangle, and the orthographic projection of the cathode support 406 is at a center of the equilateral triangle. Each of the three phosphor layers 410 is located on the end surface 420 of the corresponding anode 412. The three phosphor layers 410 are different colors such as a red phosphor layer, a green phosphor layer, and a blue phosphor layer. Each of the three cathode emitters 408 is electrically connected to the cathode support 406, and extends from the cathode support 406 to the corresponding phosphor layer 410. Each of the three cathode emitters 408 has an electron emission portion 422 adjacent to the corresponding phosphor layer 410.

In use, the pixel tube 400 can produce different color lights by controlling the different color phosphor layers 410 to luminesce. The pixel tube 400 can be used to assemble a color field emission display.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A field emission unit, comprising:

an anode;

a cathode spaced from the anode and comprising a cathode emitter, the cathode emitter comprising a carbon nanotube pipe defining a hollow axial center and comprising a first end, wherein the first end of the carbon nanotube pipe has a plurality of carbon nanotube peaks.

2. The field emission unit of claim 1, wherein the first end is oriented to the anode, and the carbon nanotube pipe further comprises a second end electrically connected to the cathode and a main body connecting the first end and the second end.

3. The field emission unit of claim 1, wherein the plurality of carbon nanotube peaks is located around an axis of the carbon nanotube pipe and spaced from each other to form a ring shape.

4. The field emission unit of claim 1, wherein each of the plurality of carbon nanotube peaks comprises a plurality of carbon nanotubes substantially parallel to each other and joined by van der Waals force.

5. The field emission unit of claim 1, wherein the carbon nanotube pipe comprises a plurality of successive carbon nanotubes helically oriented around an axis of the carbon nanotube pipe to form a continuous circumferential wall of the carbon nanotube pipe, and are joined end-to-end by van der Waals force therebetween along a helically extending direction.

6. The field emission unit of claim 1, wherein the cathode emitter further comprises a conductive linear support located in the carbon nanotube pipe.

7. The field emission unit of claim 2, wherein the first end defines an opening and comprises a hollow neck portion connected to the main body, the plurality of carbon nanotube peaks extends from a top of the neck portion to enclose the opening.

8. The field emission unit of claim 7, wherein a diameter of the hollow neck portion gradually diminishes along a direction apart from the second end.

9. The field emission unit of claim 3, wherein the plurality of carbon nanotube peaks extends along a same direction substantially parallel with the axis.

10. The field emission unit of claim 3, wherein the plurality of carbon nanotube peaks extends along different directions across the axis to form a radial shape.

11. The field emission unit of claim 10, wherein a distance between two adjacent carbon nanotube peaks gradually increases.

12. The field emission unit of claim 4, wherein each of the plurality of carbon nanotube peaks is a tapered carbon nanotube bundle, and a single projecting carbon nanotube is taller than and projects over other carbon nanotubes in each of the plurality of carbon nanotube peaks.

13. The field emission unit of claim 12, wherein the single projecting carbon nanotube is located in the middle of the other carbon nanotubes.

14. The field emission unit of claim 13, wherein a distance of the projecting carbon nanotubes of two adjacent carbon nanotube peaks is in a range from about 0.1 micrometers to about 2 micrometers.

15. The field emission unit of claim 14, wherein a ratio of the distance between the projecting carbon nanotubes of two adjacent carbon nanotube peaks and a diameter of the carbon nanotubes is in a range from about 20:1 to about 500:1.

16. The field emission unit of claim 5, wherein an angle between the helically extending direction and the axis is in a range from about 30 degrees to about 60 degrees.

17. A pixel tube for field emission display, the pixel tube comprising:

a sealed container having a light permeable portion and a field emission unit located therein, the field emission unit comprising:

an anode spaced from the light permeable portion;

a phosphor layer located on the anode; and a cathode spaced from the anode and comprising a cathode emitter, the cathode emitter comprising a carbon nanotube pipe defining a hollow axial center by a continuous circumferential wall of the carbon nanotube pipe and comprising one end defining an opening and comprising a plurality of tapered carbon nanotube bundles located around the opening.

18. The field emission unit of claim 17, wherein the anode comprises an end surface oriented to the light permeable portion, and the phosphor layer is located on the end surface.

19. The field emission unit of claim 17, wherein the end of the carbon nanotube pipe is located adjacent to, spaced from, and oriented to the phosphor layer.

20. A pixel tube for field emission display, the pixel tube comprising:

a sealed container having a light permeable portion and a plurality of field emission units located therein, each of the plurality of field emission units comprising:

an anode spaced from the light permeable portion;

a phosphor layer located on the anode; and a cathode spaced from the anode and comprising a cathode emitter, the cathode emitter comprising a carbon nanotube pipe defining a hollow axial center free of structure therein and comprising one end comprising a plurality of tapered carbon nanotube bundles located around the hollow axial center of the carbon nanotube pipe and spaced from each other to form a ring shape.

* * * * *